US008628080B2

(12) United States Patent
Hancock

(10) Patent No.: US 8,628,080 B2
(45) Date of Patent: Jan. 14, 2014

(54) METHOD AND SYSTEM FOR CONTROLLING A STAGING TRANSPORT IN A MAIL PROCESSING MACHINE

(75) Inventor: Mark S Hancock, Gaylordsville, CT (US)

(73) Assignee: Pitney Bowes Inc., Stamford, CT (US)

( * ) Notice: Subject to any disclaimer, the term of this patent is extended or adjusted under 35 U.S.C. 154(b) by 2341 days.

(21) Appl. No.: 11/317,562

(22) Filed: Dec. 23, 2005

(65) Prior Publication Data

US 2007/0145677 A1 Jun. 28, 2007

(51) Int. Cl.
*B65H 5/34* (2006.01)

(52) U.S. Cl.
USPC ..... 271/270

(58) Field of Classification Search
USPC ..... 271/270, 225, 264, 266; 198/641
See application file for complete search history.

(56) References Cited

U.S. PATENT DOCUMENTS

| | | | | |
|---|---|---|---|---|
| 3,827,545 | A * | 8/1974 | Buhayar | 198/461.2 |
| 4,331,328 | A * | 5/1982 | Fasig | 271/270 |
| 5,449,166 | A * | 9/1995 | Lohmann et al. | 271/225 |
| 7,080,834 | B2 * | 7/2006 | Asari | 271/176 |

* cited by examiner

*Primary Examiner* — Thomas Morrison
(74) *Attorney, Agent, or Firm* — Michael J. Cummings; Charles R. Malandra, Jr.; Steven J. Shapiro

(57) ABSTRACT

In a mail processing machine having a non-staging transport and a downstream staging transport for moving mailpieces, the speed of the non-staging transport is constant whereas the speed of the staging transport is controllable. In normal operation, both the staging and non-staging transports move the mailpieces downstream in the same constant speed. When a jam occurs downstream from the staging transport, the staging transport is effectively slowed down so that the staging transport can hold additional mailpieces before they arrive at the jam site during the jam clearance process. After the jam has been cleared, the staging transport is controlled in order to re-gap the mailpieces already released from the non-staging transport. After re-gapping is completed, the staging transport is sped up so that the mail processing machine is returned to its normal operation.

12 Claims, 5 Drawing Sheets

METHOD AND SYSTEM FOR CONTROLLING A STAGING TRANSPORT IN A MAIL PROCESSING MACHINE

TECHNICAL FIELD

The present invention relates generally to a mail processing machine and, more particularly, to a mail processing machine having a staging transport and a non-staging transport.

BACKGROUND OF THE INVENTION

Inserter systems, such as those applicable for use with the present invention, are mail processing machines typically used by organizations such as banks, insurance companies and utility companies for producing a large volume of specific mailings where the contents of each mail item are directed to a particular addressee. Examples of such inserter systems are the 8 series, 9 series, and APS™ inserter systems available from Pitney Bowes Inc. of Stamford, Conn.

In many respects, the typical inserter system resembles a manufacturing assembly line. Sheets and other raw materials (other sheets, enclosures, and envelopes) enter the inserter system as inputs. Then, a variety of modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

One problem that arises with high speed mail processing machines is jamming. When a jam occurs, not only is there potential for the jammed piece to be damaged, but also collateral damage from moving pieces that may crash into the jammed mail pieces, or that may otherwise be forced to come to a sudden halt. In order to minimize damage, it is known to shut down the mail processing machine upon the occurrence of a jam to minimize collateral damage, and so that the jam can be cleared.

One complication is that some transports, by their nature, cannot be shut down while documents are still under their control. One example, is a Pitney Bowes R150 postage meter mailing machine that prints postage indicia. For the integrity of the postage printing process, an R150 mailing machine is not shut down while envelopes are within its control. Accordingly, if a jam occurs anywhere downstream of the R150 mailing machine, then envelopes within the mailing machine at the time may become collaterally damaged when they are suddenly halted downstream of the R150 mailing machine transport system.

For purposes of this description, the term "non-staging transport" refers to a transport, such as in the R150 mailing machine, that continues to run, even after a jam has been detected. It will be understood by one skilled in the art that there are also other examples of non-staging transports used elsewhere, whereby transport rollers and belts run continuously regardless of whether there is a jam, or whether documents are currently being processed.

Thus, stated more generically, in a mail processing machine where one or more of the upstream modules are non-staging, a problem arises when there is a jam downstream. Because the upstream mailpieces are conveyed by a transport that cannot stage mailpieces, the downstream transport mechanism must continue to accept the mailpieces before the non-staging transport is caused to stop in order to avoid a second jam. In the past, when a jam occurs, the transport mechanism downstream of the non-staging area is stopped as soon as the last mailpiece leaves the non-staging area. This results in the pile up of some mailpieces in the jam area, or in a portion of the transport that has halted as a result of the jam. However, before the downstream transport is stopped, not all of the received mailpieces can be staged in a normal manner, some of them end up at the jam location. Such a pile up may cause collateral damage.

SUMMARY OF THE INVENTION

For purposes of this description, a staging transport in a mail processing machine is used to receive and store mailpieces from a non-staging transport in a controlled fashion when the mail processing machine is shut down because of a jam, or some other shut down situation. In a staging transport module, the mailpieces can be sped up or slowed down if necessary, or desired, in order to receive and store mailpieces so that they do not come to a halt in a pile-up. Thus, the speed of a mailpiece within the staging module may not always be constant. In contrast, a non-staging transport is used in a module where the speed of a mailpiece is constant unless the transport is completely shut down. An exemplary arrangement of a staging transport and a non-staging transport are depicted in FIG. 1.

According to the present invention, a mail processing machine has a non-staging transport and a downstream staging transport. The speed of the non-staging transport is constant whereas the speed of the staging transport is controllable. In normal operation, both the staging transport and the non-staging transport move the mailpieces downstream at the same constant speed. When a jam occurs downstream from the staging transport, the staging transport is effectively slowed down so that the staging transport can hold additional mailpieces before they arrive at the jam site. After the jam has been cleared, the staging transport is controlled in order to re-gap the mailpieces already released from the non-staging transport. After re-gapping is completed, the staging transport is sped up so that the mail processing machine can be returned to its normal operation. In particular, the speed of the staging transport during the machine stoppage condition has a speed profile that includes deceleration and acceleration sessions so as to control the gap between the mailpieces in the staging transport.

According to the present invention, a mail processing machine has a non-staging transport and a staging transport downstream from the staging transport. The speed of the non-staging transport is constant whereas the speed of the staging transport is controllable. In normal operation, both the staging transport and the non-staging transport move the mailpieces downstream at the same constant speed. When a jam occurs downstream from the staging transport, the staging transport is effectively slowed down so that the staging transport can hold additional mailpieces before they arrive at the jam site. After the jam has been cleared, the staging transport is controlled in order to re-gap the mailpieces already released from the non-staging transport. After re-gapping is completed, the staging transport is sped up so that the mail processing machine can be returned to its normal operation. In particular, the speed of the staging transport during the machine stoppage condition has a speed profile that includes deceleration and acceleration sessions so as to control the gap between the mailpieces in the staging transport.

DETAILED DESCRIPTION OF THE INVENTION

Figure 1:
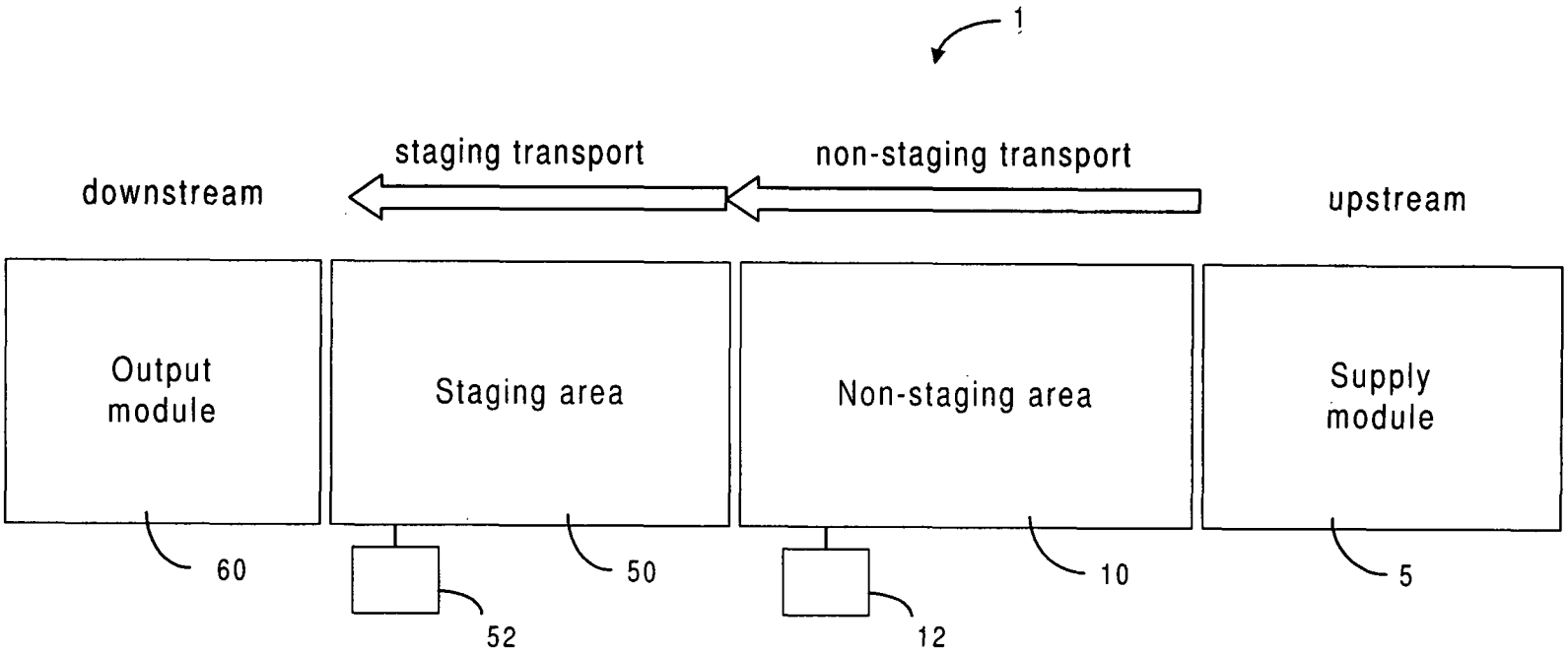
FIG. 1 is a schematic representation showing a mail processing machine having a staging module downstream of a non-staging module.
Figure 2:
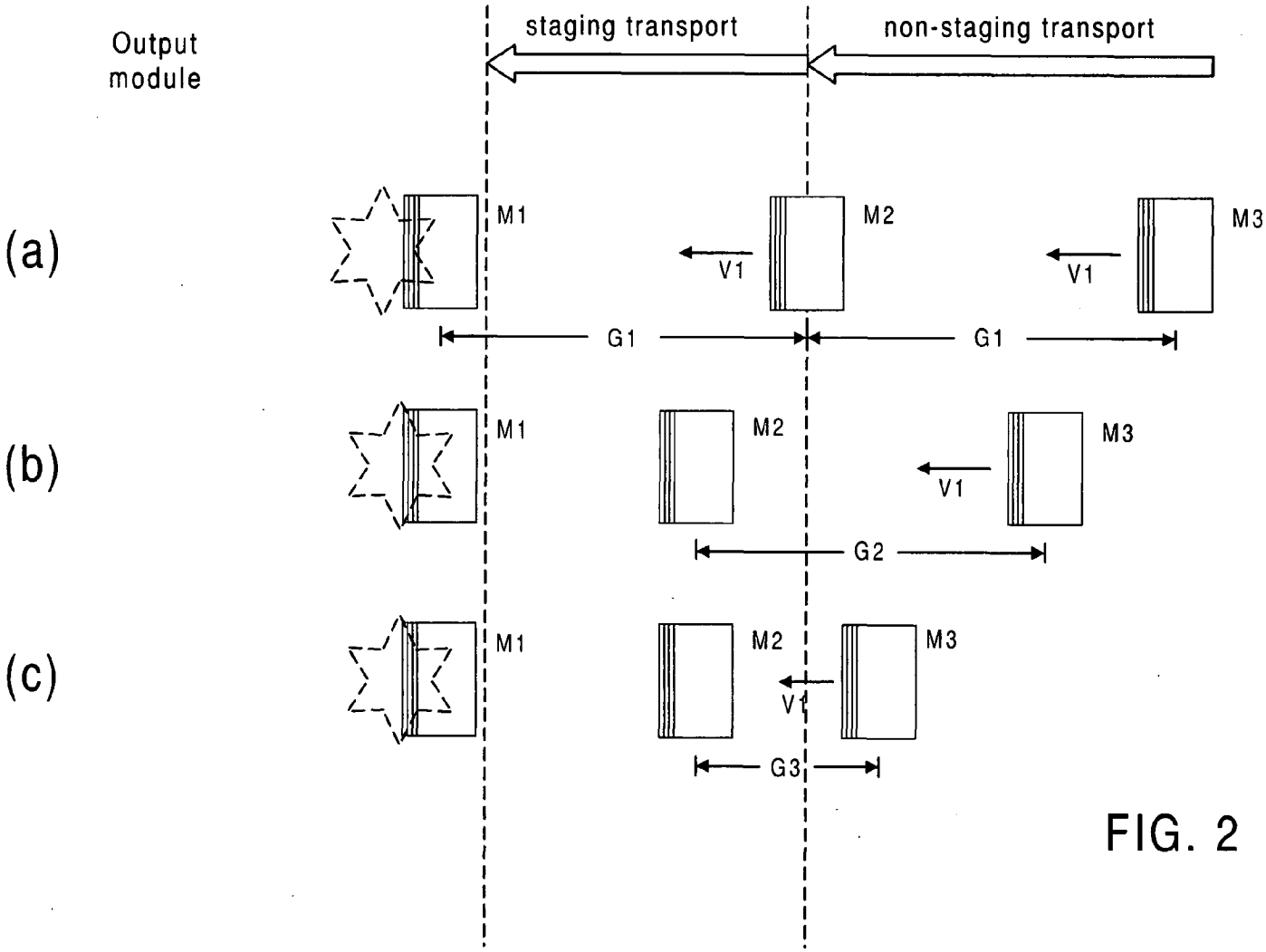
FIG. 2*a* is a schematic representation showing the spatial relationship between the mailpieces in the staging and non-staging areas when a jam occurs.
FIG. 2*b* is a schematic representation showing the spatial relationship between those mailpieces when the staging transport is stopped.
FIG. 2*c* is a schematic representation showing the arrival of a non-staged mailpiece at the staging area.
FIG. 2*d* is a schematic representation showing a jogging process being used to move the staged mailpieces downstream while the non-staged stack becomes staged.
FIG. 2*e* is a schematic representation showing the staging transport is paused or slowed down for jam clearance.
FIG. 2*f* is a schematic representation showing the staging transport is restarted in order to release one of the staged mailpieces.
FIG. 2*g* is a schematic representation showing one of the staged mailpieces is released downstream in a re-gapping process.
FIG. 2*h* is a schematic representation showing the completion of the re-gapping process.
FIG. 2*i* is a schematic representation showing the last staged mailpiece being released downstream.
Figure 2:
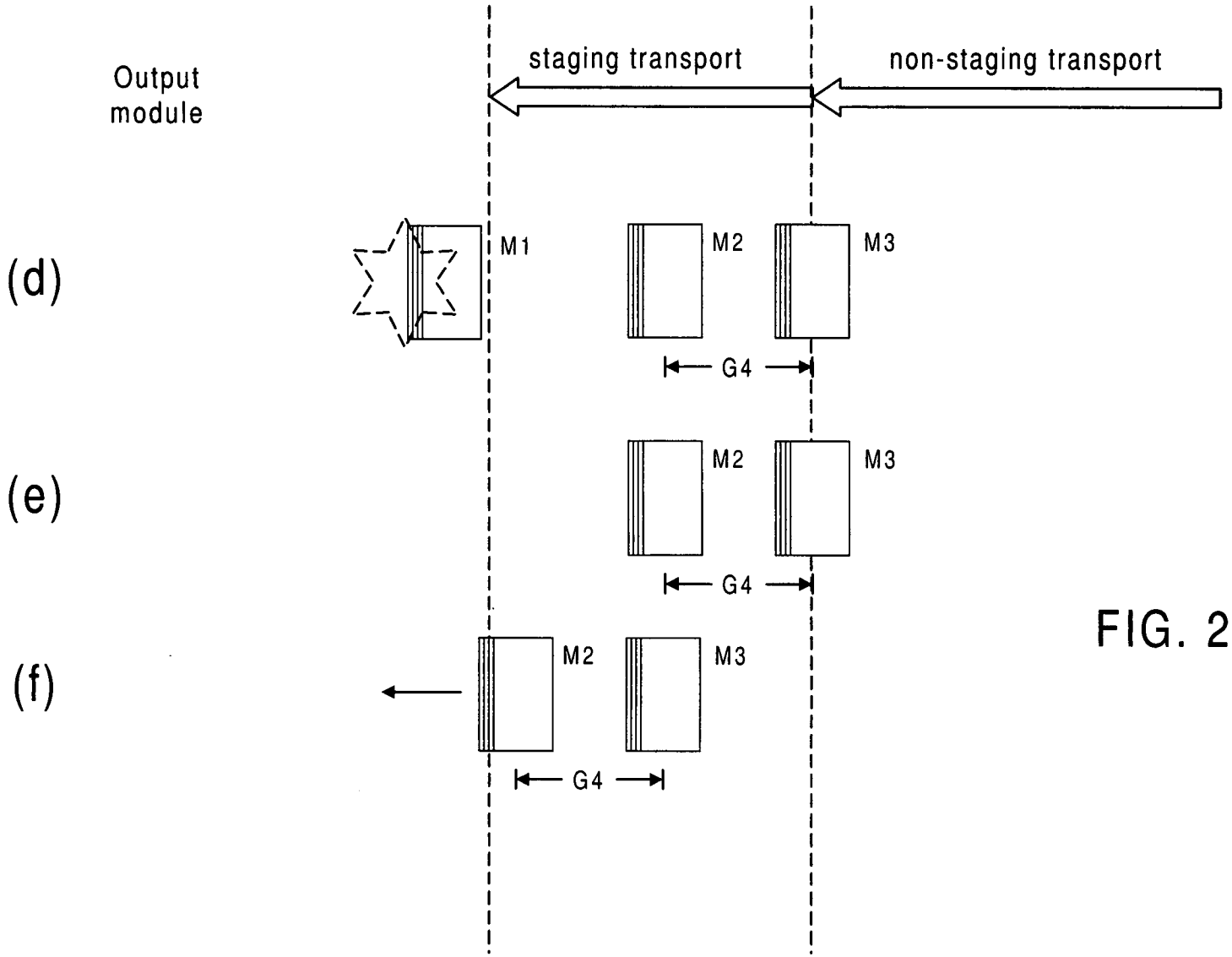
Figure 2:
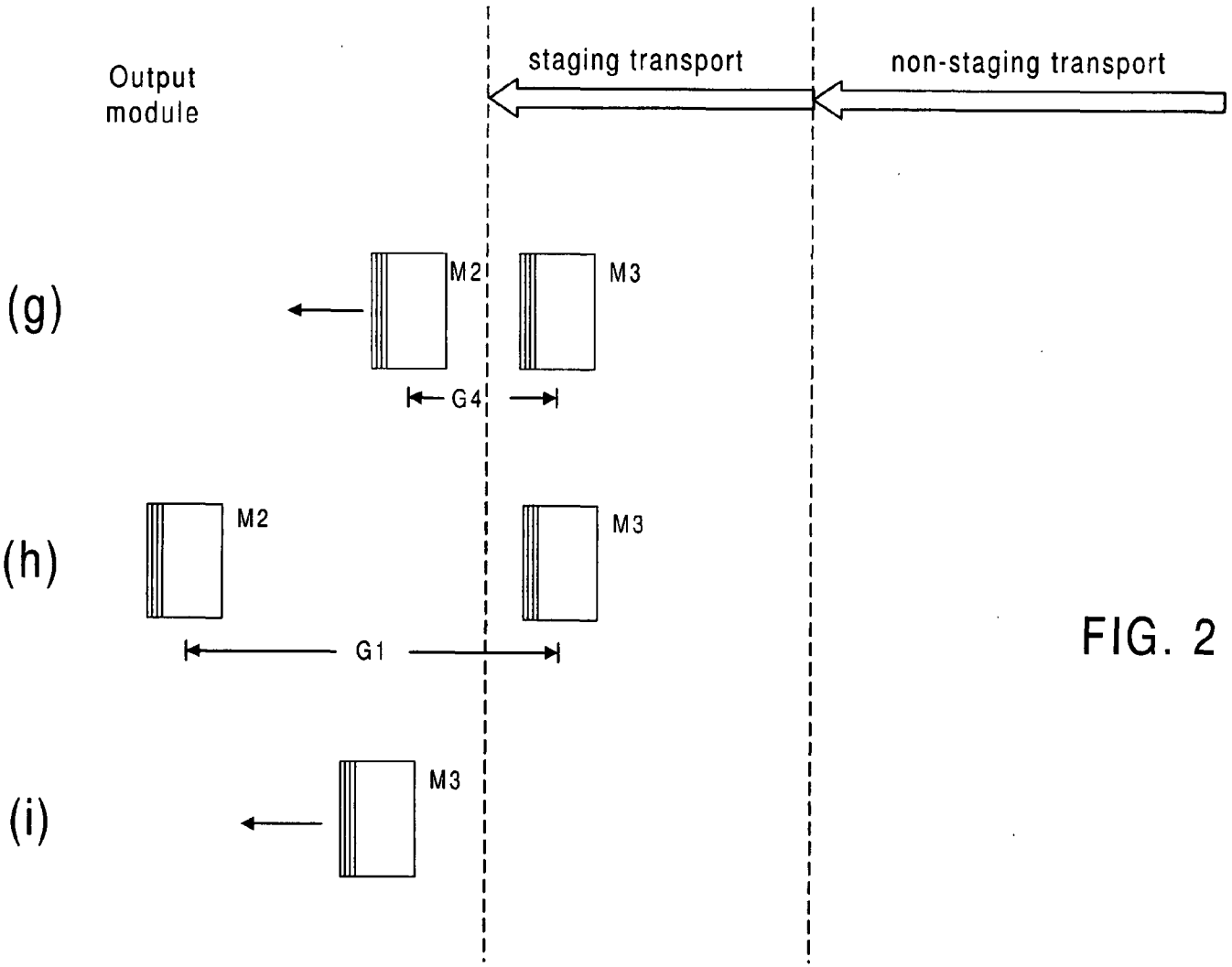

As shown in FIG. 1, a mail processing machine 1 has a non-staging area 10 where mailpieces (not shown) are moved by a non-staging transport, and a staging area 50 where mailpieces received from the non-staging area are moved downstream by a staging transport. The non-staging transport is driven by a movement means 12 such as a motor with a substantially constant speed. Transport mechanisms, such as belts and rollers, for transporting documents in a mail processing machine 1 are well know in the art and do not need to be described further here. The staging transport is driven by a separate movement means 52 having a variable speed which can be slowed down or sped up if necessary. In addition, the mail processing machine 1 also has a supply module 5 upstream from the non-staging area 10 for serially supplying mailpieces, one at a time, to the non-staging area 10, and an output module 60 downstream from the staging area 50 for further transport and/or processing of mailpieces received from the staging area 50. FIGS. 2*a* to 2*i* show the method for controlling the staging transport, according to the present invention, in order to avoid a subsequent jam in case a jam occurs downstream. In the following illustration, it is assumed that, under normal operations, mailpieces are typically moved downstream at a substantially constant speed V1 in both the non-staging area and in the staging area, and that the gap between two adjacent mailpieces is G1 at all times. Thus, at the moment when a jam occurs, the gap between two adjacent mailpieces is G1, as shown in FIG. 2*a*.

As shown in FIG. 2*a*, the mailpiece M1 is caught at a jam location in the output module 60 waiting for clearing. At the same time, the mailpiece M2 is in the staging area, whereas the mailpiece M3 is still in the non-staging area. Before the jam occurs, M2 and M3 are moved, respectively, by a staging transport and a non-staging transport at substantially the same velocity, V1, so that the gap G1 between the two mailpieces is substantially the same. After the jam occurs, the staging transport is quickly decelerated and subsequently stopped in order to prevent the staged mailpiece M2 from moving into the jam area before the jam has been cleared. FIG. 2*b* shows that M2, along with the staging transport, becomes stationary while the non-staging transport is still moving the non-staged mailpiece M3 at the same speed V1 downstream. The gap has reduced to G2. As mailpiece M3 is moved further downstream at the same speed V1, it approaches the staging area and the gap between M2 and M3 is further reduced to G3, as shown in FIG. 2*c*. In order to allow additional mailpiece M3 and others to be staged, it is possible to move M2 downstream by jogging the staging transport at a jogging speed V2 until M3 is staged, as shown in FIG. 2*d*. Such jogging includes rapid acceleration to receive M3 without causing a crash, and subsequent deceleration to bring M3 and M2 back to rest. Now the gap between M2 and M3 is reduced to G4. Because the gap G4 is much smaller than G1, there would be sufficient room for additional mailpieces to be staged if necessary. Thus the jogging process may be repeated for as many subsequent mailpieces as the staging area 50 can hold.

As soon as the jam occurs, it is preferable to halt the supply of the mailpieces from the supply module upstream from the non-staging area (see FIG. 1) to ensure that no more mailpieces arrive at the staging area 50 than can be handled by the length of the staging area 50. In FIG. 2*d*, the staging transport is stationary. Subsequently, the jam is cleared while both M2 and M3 remains stationary as shown in FIG. 2*e*.

After the jam is cleared, the re-gapping process begins with the staging transport moving M2 and M3 downstream together, as shown in FIG. 2*f*. As soon as M2 is released into the output module 60, the staging transport can be substantially slowed down or paused, as shown in FIG. 2*g*, so as to widen the gap between M2 and M3. As M2 continues to move downstream in the output module 60, the gap between M2 and M3 reaches G1, as shown in FIG. 2*h*. At this point, the re-gapping process is completed and the staging transport moves again to release M3 into the output module, as shown in FIG. 2*i*. The normal operation of the mail processing machine can be resumed.

During jam clearance and the re-gapping process, the staging transport is decelerated and accelerated a number of times. As illustrated in the velocity profile of FIG. 3, as soon as the jam occurs (see FIG. 2*a*) at T1, the staging transport is slowed down until it stops at T2. At T2, the mailpiece M2 is stationary, as shown in FIGS. 2*b* and 2*c*. As the mailpiece M3 is approaching the staging transport, the staging transport is accelerated at T3 so as to be moving rapidly enough to receive the approaching mailpiece M3, as shown in FIG. 2*d*. The peak velocity between T3 and T4 should be enough that the mailpiece can be received from the non-staging transport moving at V1 without damaging the mailpiece. Preferably, to minimize the potential for damage, this peak velocity would match V1. After the mailpiece M3 is staged at T4, the staging transport is again paused until the jam is cleared as shown in FIG. 2*e*. After the jam is cleared at T5, the staging transport is accelerated in order to release M2 into the output module, as shown in FIG. 2*f*. After M2 is released at T6 as shown in FIG. 2*g*, the staging transport is paused in order to widen the gap between M2 and M3. After the re-gapping process is completed as shown in FIG. 2*h*, the staging transport is accelerated at T7 until its velocity reaches V1 at T8. M3 is released as shown in FIG. 2*i* and the staging transport resumes its normal operation.

It should be noted that, as shown in FIGS. 2*d*-2*f*, the number of mailpieces on the staging transport after the jam occurs is two. However, it is possible to have a longer staging area to accommodate more mailpieces, if so desired.

Figure 3:
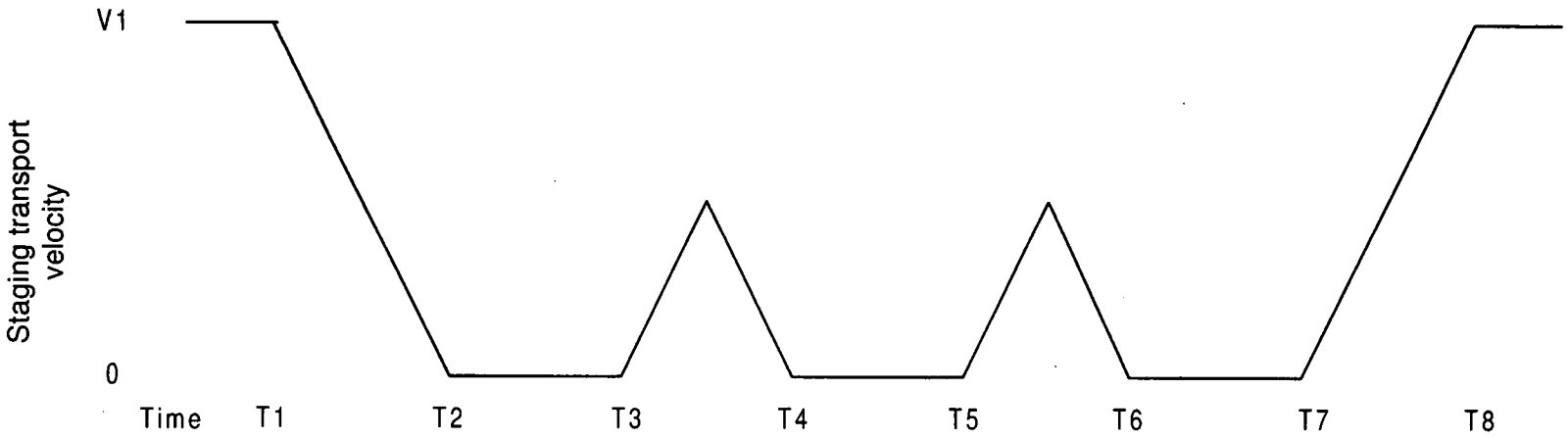
FIG. 3 is an exemplary velocity profile of the staging transport, according to the present invention.

Thus, the mail process machine 1, according to the present invention, is operable at least in a first mode and a second mode. In the first mode, the staging transport is driven by a moving mechanism in a constant speed V1. In the second mode, the staging transport is decelerated and accelerated to receive and store closely spaced mailpieces. The motion profile of FIG. 3 is only exemplary. Depending upon the number of the mailpieces to be staged and speed of the non-staging transport, the staging transport may be or may not be required to stop between deceleration and acceleration. Furthermore, it is possible to have a period of constant speed between acceleration and deceleration. The main purpose of slowing down the staging transport is to reduce the gap between adjacent mailpieces in the staging area. After the jam is cleared and the re-gapping process is completed, the staging transport resumes its operation in the first mode.

The motion profile for receiving mailpieces within the staging transport is triggered by known sensors (not shown) for detecting the arrival of the mailpieces at the staging transport. Such sensors may include optical sensors which are well known in the mail processing art, and to not need to be described further here.

Although the invention has been described with respect to one or more embodiments thereof, it will be understood by those skilled in the art that the foregoing and various other changes, omissions and deviations in the form and detail thereof may be made without departing from the scope of this invention. In particular, the invention has been described as pertaining to stoppage of the mail processing machine upon the occurrence of a jam. It will be understood that the invention is equally applicable for staging mailpieces when other stoppage conditions occur.

What is claimed is:

1. A mail processing machine for moving a plurality of mail items from upstream to downstream, the mail processing machine operable at least in a first steady state mode and in a second staging mode, said mail processing machine comprising:

a staging section; and a non-staging section positioned upstream from the staging section and arranged to transport mail items one at a time to the staging section, wherein the non-staging section has a first movement mechanism to move the mail items downstream onto the staging section substantially at a constant first speed, wherein two adjacent ones of the mail items in the non-staging section are separated by a first gap; and the staging section has a second movement mechanism comprising a controller to transport the mail items received from the non-staging section at a controllable second speed, wherein a first mail item in the staging section is separated from a subsequent mail item by a second gap, wherein when the mail processing machine is operated in the first steady state mode, the second speed is controlled by the controller such that the second gap is substantially equal to the first gap, and when the mail processing machine is operated in the second staging mode, the first movement mechanism continues to operate at the first speed while the second speed of the staging section is controlled by the controller to receive mail items at the first speed and to decelerate after the mail item is received, thereby causing the second gap within the staging section to be smaller than the first gap, and wherein the staging section is controlled by the controller, after decelerating the first mail item, to accelerate to receive the subsequent mail item from the non-staging section, and then to decelerate both the first and subsequent mail items to be stored in the staging section separated by the second gap.

2. The mail processing machine of claim 1, further comprising an output section including a transport operating at the first speed, downstream from the staging section, and wherein the mail processing machine is operable in a third regapping mode, used after the second staging mode is complete, and wherein the staging section is controlled by the controller to accelerate to release mail items to the output section and to decelerate after the first mail item has been released in order to increase a gap length between the first and subsequent mail items.

3. The mail processing machine of claim 2, wherein after said first mail item has been released to the output section, the output section is controlled by the controller to move said first mail item away from the staging section at a speed greater than the second speed so as to increase the gap between said first mail item and said subsequent mail item.

4. The mail processing machine of claim 3, wherein when the gap between said first mail item and said subsequent mail item in the output section is substantially equal to the first gap, the staging section further being controlled by the controller to return to the first steady state mode after operating in the third regapping mode.

5. A method to control movement in a mail processing machine for moving a plurality of mail items from upstream to downstream, the mail processing machine operable at least in a first mode and in a second mode, the mail processing machine comprising a first section, a second section positioned downstream from the first section, and a third section downstream from the second section, said method comprising the steps of:

when the mail processing machine is operated in the first mode, transporting the mail items in the first section in a first constant velocity toward the second section, and transporting the mail items in the second section downstream in the first velocity so that a gap between adjacent mail items in the first section is substantially equal to a gap between adjacent mail items in the second section; and when the mail processing machine is operated in the second mode, transporting the mail items in the first section in the first velocity toward the second section, and transporting the mail items in the second section downstream in a second velocity smaller than the first velocity so that the gap between adjacent mail items in the second section is smaller than the gap between adjacent mail items in the first section, wherein transporting the mail items in the second section downstream includes a deceleration session for pausing a last mail item in the second section until a following mail item from the first section is moved into the second section, and an acceleration session for moving both said last mail item and said following mail item toward the third section so as to release said last mail item to the third section.

6. The method of claim 5, further comprising the step of transporting said last mail item released to the third section further downstream in a third velocity greater than the second velocity so as to increase the gap between said last mail item and said following mail item.

7. A method for transporting mail items in a mail processing machine to avoid damage resulting from a stoppage condition:

transporting serial mail items in a non-staging section at a constant first speed, the serial mail items positioned apart by a first gap distance;

transporting serial mail items received from the non-staging section on a staging section at a controllable second speed and wherein two adjacent ones of the mail items in the staging section are separated by a second gap;

operating the mail processing machine in a first steady state mode wherein the second speed is controlled such that the second gap is substantially equal to the first gap, and operating the mail processing machine in a second staging mode, wherein the non-staging section continues to operate at the first speed while the second speed of the staging section is controlled to receive mail items at the first speed and to decelerate after a first mail item is received, thereby causing the second gap within the staging section to be smaller than the first gap, and after decelerating the first mail item, to accelerate to receive a subsequent mail item from the non-staging section, and then to decelerate both the first and subsequent mail items to be stored in the staging section separated by the second gap.

8. The method of claim 7 further comprising the step of triggering the second staging mode upon the occurrence of a jam condition downstream of the staging section.

9. The method of claim 7, further comprising a step of operating the mail processing machine in a third regapping mode, applied after the second staging mode, whereby spacing between subsequent mail items is increased as they are output from the staging section by accelerating to release mail items from the staging section and decelerating after the first mail item has been released in order to increase a gap length gap between the first and subsequent mail items.

10. The method of claim 9 further comprising the step of triggering the third regapping mode after a stoppage condition has been cleared.

11. The method of claim 9, wherein after said first mail item has been released to an output section, moving said first mail item away from the staging section at a speed greater than the second speed so as to increase the gap between said first mail item and said subsequent mail item.

12. The method of claim 11, wherein when the gap between said first mail item and said following mail item is substantially equal to the first gap, further comprising the step of controlling the staging section to return to the first steady state mode.

* * * * *